United States Patent [19]

Ott

[11] 4,446,974

[45] May 8, 1984

[54] CARPET DISPLAY RACK

[75] Inventor: David A. Ott, LaGrange, Ga.

[73] Assignee: Milliken Research Corporation, Spartanburg, S.C.

[21] Appl. No.: 369,616

[22] Filed: Apr. 19, 1982

[51] Int. Cl.[3] ..... A47F 7/16

[52] U.S. Cl. ..... 211/45; 211/60 R

[58] Field of Search ..... 211/45, 46, 44, 47, 211/48, 113, 193, 60 R

[56] References Cited

U.S. PATENT DOCUMENTS

| | | | |
|---|---|---|---|
| 384,626 | 6/1888 | Hilleary et al. | 211/44 X |
| 674,069 | 5/1901 | Snively . | |
| 819,989 | 5/1906 | Gilbert | 211/48 |
| 1,637,573 | 8/1927 | Johansson | 211/44 X |
| 1,960,095 | 5/1934 | Tonnesen | 248/300 X |
| 1,994,981 | 3/1935 | Cook | 35/50 |
| 2,117,285 | 5/1938 | Bitzer | 211/60 R |
| 2,839,200 | 6/1958 | Easterwood | 211/45 |
| 3,094,216 | 6/1963 | Gordon | 211/45 |
| 3,472,387 | 10/1969 | Olsen | 211/45 |
| 3,534,863 | 10/1970 | Howard | 211/47 |

*Primary Examiner*—Ramon S. Britts
*Assistant Examiner*—Robert W. Gibson, Jr.
*Attorney, Agent, or Firm*—Earle R. Marden; H. William Petry

[57] ABSTRACT

Carpet display rack which allows even spacing and easy removal of carpet samples which have the top portion thereof angled to allow a better viewing of the sample. The carpet display rack has a novel track system which ensures that the top of each carpet sample is held at the desired viewing angle.

1 Claim, 4 Drawing Figures

CARPET DISPLAY RACK

This invention relates to improvements in a carpet diaplay rack for displaying carpets to the public and allowing easy removability thereof for the purposes of inspection.

Therefore the object of the invention is to provide a new and novel carpet display rack which allows efficient display of carpet samples.

Other objects and advantages of the invention will become readily apparent as the specification proceeds to describe the invention with reference to the accompanying drawing, in which.

Figure 1:
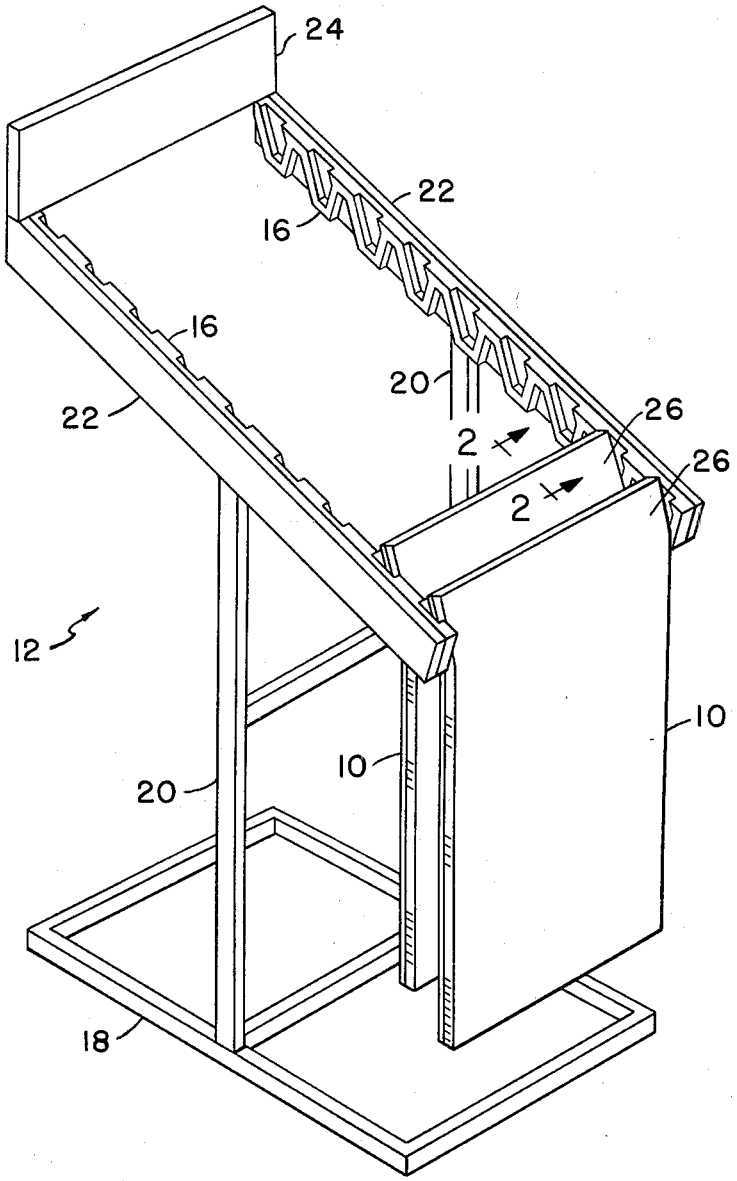
FIG. 1 is a perspective view of the new and novel display rack.

Looking now to FIG. 1 there is shown in perspective a plurality of carpet samples 10 hung in a rack, generally designated 12, by an elongated support member 14 mounted on the back of each sample 10 which engages the tracks 16 at both ends. The specific embodiment is directed to the display of carpet samples but the invention encompasses any samples of product such as upholstery, linoleum, etc. which it is desired to display so that the customer can view and remove the displayed product.

The display rack 12 consists of a rectangular base 18 with upstanding supports 20 to which the track support members 22 are attached. Mounted across the top of the two support members 22 is interconnecting member 24 to provide lateral rigidity as well as a visual display area. The tract support members 22 are mounted at an angle of approximately 30° to the horizontal so that the tops of a plurality of carpet samples 10 can be viewed at one time as they hang in the tracks 16 which are mounted, by any suitable means, to the insides of the support members 22.

In displaying samples of products such as carpet it is desired to provide a maximum view to the customer and at the same time allow ease of removal of the desired sample for a closer inspection. As discussed above, initially it is desired to hang the samples, one slightly above the other, by mounting them on an inclined plane. Further the samples should be evenly spaced. Finally it is desired to bend the top 26 of the sample backwards to give the viewer a better look at the sample without removal of same. This is accomplished as hereinafter described.

To maintain the top portion 26 of the sample in bent back condition the elongated support member 14, of plastic or other suitable material, is connected thereto by a plurality of spaced fasteners or rivets 28. The elongated support member 14 is basically "L" shaped with an upstanding portion 30, a leg 32 and a bent back portion 34. The elongated support member 14 is supported at its ends in the slots 36 molded in the tracks 16.

Figure 2:
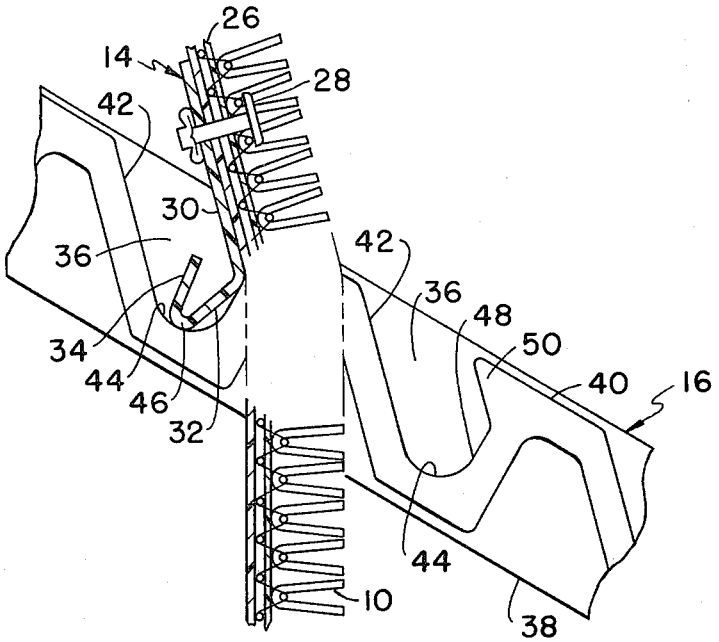
FIG. 2 is a view taken on line 2—2 showing one piece of carpet sample in situ in the display rack.
Figure 3:
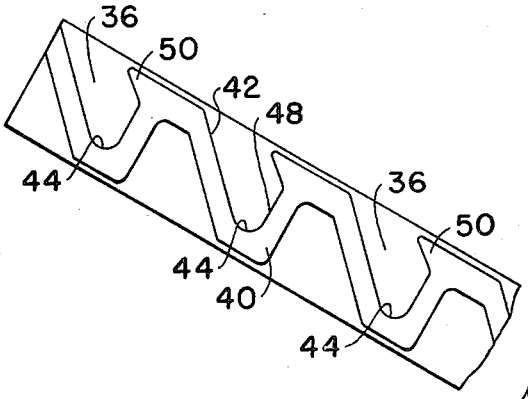
FIG. 3 is a side elevation view of one of the carpet display tracks.
Figure 4:
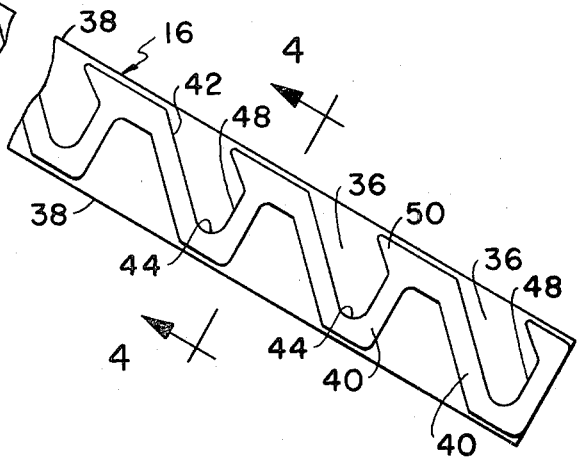
FIG. 4 is a section view taken on line 4–4 of FIG. 3.
Figure 4:
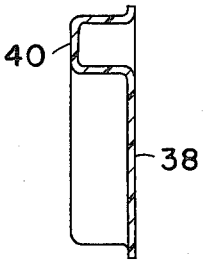

The tracks 16, of plastic or other suitable material, basically consist of a wall portion 38 and raised portions 40. The raised portions 40 are so molded to provide the plurality of slots 36. Each slot has a slanted wall portion 42 to allow easy insertion and removal of the support member 14, a rounded bottom portion 44 to provide support for the portion 46 of the support member 14, an upstanding wall portion 48 and a triangular flange portion 50 to engage and support the portion 30 of the support member 14 to maintain the sample top 26 in the bent back position as shown in FIG. 2.

It can be seen that a carpet sample rack has been provided which will allow a plurality of carpet samples to be viewed simultaneously with the sample having the top thereof bent back to provide for observation of the sample. The carpet further provides support to maintain the top of the carpet samples in the bent back position but also allows easy removal and insertion of the individual samples in the carpet dsample display rack.

Although the preferred embodiment of the invention has been described in detail, it is contemplated that many changes may be made without departing from the scope or spirit of the invention and I desire to be limited only by the claims.

I claim:

1. A carpet sample display rack comprising: a base member, upstanding support means connected to said base member and sample support means connected to said upstanding support means at an angle to said base member, said sample support means including a pair of spaced sample support tracks spaced from one another, each of said support tracks having a plurality of upwardly opening slots on the inside surface thereof with the slots in one of said support tracks being substantially diametrically opposite to the slots in the other of said support tracks, each of said support tracks having a longitudinal axis and an axis perpendicular thereto, each of said slots having a front side and a rear side with the rear side being larger than the front side, said rear side of each slot being inclined in a direction away from the front side of said sample display rack while the front side of said slots is substantially parallel to the perpendicular axis of said support member, said front side of each of said slots having a projection thereon projecting towards the rear side of said slot to maintain the top of a carpet sample placed in said slot in a bent back position to provide for ready observation of the carpet sample, said sample support tracks being a molded, plastic member with said slots being only in one face thereof where by the remaining position of said sample track supports prevents the sample support member for a sample supported in said slots from projecting outwardly from the sides of said carpet sample display rack.

* * * * *

UNITED STATES PATENT AND TRADEMARK OFFICE

CERTIFICATE OF CORRECTION

PATENT NO. : 4,446,974

DATED : May 8, 1984

INVENTOR(S) : David A. Ott

It is certified that error appears in the above-identified patent and that said Letters Patent is hereby corrected as shown below:

Column 1, line 5, "diaplay" should be "display".

Column 2, line 22, "dsample" should be "sample".

Column 2, line 53, "where by" should be "whereby".

Column 2, line 53, "position" should be "portions".

Signed and Sealed this

*Second* Day of *October 1984*

[SEAL]

*Attest:*

GERALD J. MOSSINGHOFF

*Attesting Officer*

*Commissioner of Patents and Trademarks*